US010982915B2

(12) United States Patent
Hui

(10) Patent No.: US 10,982,915 B2
(45) Date of Patent: Apr. 20, 2021

(54) APPARATUS AND METHOD TO FACILITATE COLLECTING FLUID FROM WALL-MOUNTED APPLIANCES

(71) Applicant: CLEAN COIL SYSTEMS LLC, South Euclid, OH (US)

(72) Inventor: Michael John Hui, Morton Grove, IL (US)

(73) Assignee: CLEAN COIL PRODUCTS LLC, Euclid, OH (US)

( * ) Notice: Subject to any disclaimer, the term of this patent is extended or adjusted under 35 U.S.C. 154(b) by 0 days.

(21) Appl. No.: 16/514,743

(22) Filed: Jul. 17, 2019

(65) Prior Publication Data

US 2020/0025469 A1 Jan. 23, 2020

Related U.S. Application Data

(60) Provisional application No. 62/699,183, filed on Jul. 17, 2018.

(51) Int. Cl.
*B08B 15/02* (2006.01)
*F28G 15/00* (2006.01)
(Continued)

(52) U.S. Cl.
CPC ..... *F28G 15/00* (2013.01); *B08B 15/02* (2013.01); *B08B 15/04* (2013.01); *B08B 15/023* (2013.01);
(Continued)

(58) Field of Classification Search
CPC ... F28G 15/00; F28G 2015/006; B08B 15/04; B08B 15/02; B08B 15/023; B08B 2203/0229; F24F 1/0057; F24F 2221/225
See application file for complete search history.

(56) References Cited

U.S. PATENT DOCUMENTS 6,863,116 B1 * 3/2005 Kane ..... B08B 17/00 15/104.03
6,990,987 B1 * 1/2006 Smith ..... B08B 9/0323 134/104.2
(Continued)

FOREIGN PATENT DOCUMENTS

CN 201482746 U 5/2010
CN 201659105 U 12/2010
(Continued)

*Primary Examiner* — Nicolas A Arnett
(74) *Attorney, Agent, or Firm* — Tarolli, Sundheim, Covell & Tummino LLP

(57) ABSTRACT

As an example, an apparatus includes a hood portion and a body portion. The hood portion includes a distal opening adapted to be positioned around a periphery of a wall-mounted appliance. The hood portion includes a sidewall of a pliant material extending outwardly from a perimeter of the distal opening to terminate in a proximal opening having a perimeter that is spaced apart from and opposing the distal opening. The proximal opening is to provide access to an interior volume of the hood portion corresponding to the sidewall between the first and second openings. The body portion extends from the perimeter of the proximal opening in a longitudinal direction that is substantially transverse to a central axis of the distal opening. An outlet in fluid communication with the body portion is to enable discharge of fluids from an interior volume of the body portion.

22 Claims, 8 Drawing Sheets

(51) Int. Cl.
*B08B 15/04* (2006.01)
*F24F 1/0057* (2019.01)

(52) U.S. Cl.
CPC ..... *F24F 1/0057* (2019.02); *F24F 2221/225* (2013.01); *F28G 2015/006* (2013.01)

(56) References Cited

U.S. PATENT DOCUMENTS

| | | | | |
|---|---|---|---|---|
| 9,259,769 | B1 | 2/2016 | Kane | |
| 9,476,658 | B1 * | 10/2016 | Rojas | F24F 13/222 |
| 10,081,038 | B2 * | 9/2018 | Steinmann | B08B 5/02 |
| 10,144,628 | B1 * | 12/2018 | Hardy | B65D 33/14 |
| 10,378,780 | B2 * | 8/2019 | Kurosu | F24F 1/0057 |
| 2003/0024552 | A1 * | 2/2003 | Watanabe | B08B 17/00 134/26 |

FOREIGN PATENT DOCUMENTS

| | | | |
|---|---|---|---|
| CN | 202162189 | U | 3/2012 |
| CN | 202377219 | U | 8/2012 |
| CN | 203124384 | U | 8/2013 |
| CN | 203437394 | U | 12/2014 |
| CN | 204769660 | U | 11/2015 |
| CN | 107185883 | A | 9/2017 |
| CN | 107702309 | A | 2/2018 |
| CN | 206276653 | U | 6/2018 |
| JP | 2000179888 | A | 6/2000 |
| KR | 20150110003 | A | 10/2015 |

* cited by examiner

APPARATUS AND METHOD TO FACILITATE COLLECTING FLUID FROM WALL-MOUNTED APPLIANCES

CROSS-REFERENCE TO RELATED APPLICATION

This application claims the benefit of U.S. Provisional Patent Application No. 62/699,183 filed Jul. 17, 2018, entitled NOVEL WASTE WATER COLLECTION AND OVERSPRAY PREVENTION BAG FOR THE MAINTENANCE OF DUCTLESS WALL SPLIT AIR CONDITIONER INDOOR HEAT EXCHANGERS, the entirety of which is incorporated by reference herein.

TECHNICAL FIELD

This application relates to methods and apparatuses to collect cleaning fluid from wall-mounted appliances.

BACKGROUND

Ductless wall split air conditioners have increased in popularity due to their energy efficiency and ease of installation. However, due to their physical placement inside of rooms (in contrast to conventional central air conditioners that are installed in dedicated machine rooms outside of living or working spaces), maintenance of these air conditioners can be difficult. Difficulties include damage to nearby drywall, furniture, and other assets by water overspray, damage to surroundings caused by coil cleaning chemicals, and dangers caused by water accumulation on floors.

Additionally, coil cleaning spray chemicals made to be applied in a "no-rinse" cleaning method are popular, but do not provide the profundity of cleaning required to maintain the air conditioner at factory efficiencies. Washing with coil cleaners and pressurized water remains the preferred cleaning approach to adequately release accumulated dirt from the unit. However, water overspray and leakage is always a concern.

SUMMARY

In one example, an apparatus includes a hood portion and a body portion. The hood portion includes a distal opening adapted to be positioned around a periphery of a wall-mounted appliance. The hood portion includes a sidewall of a pliant material extending outwardly from a perimeter of the distal opening to terminate in a proximal opening having a perimeter that is spaced apart from and opposing the distal opening. The proximal opening is to provide access to an interior volume of the hood portion corresponding to the sidewall between the first and second openings. The body portion extends from the perimeter of the proximal opening in a longitudinal direction that is substantially transverse to a central axis of the distal opening. An outlet in fluid communication with the body portion is to enable discharge of fluids from an interior volume of the body portion.

In another example, a method to facilitate servicing a wall-mounted appliance includes placing a perimeter of a distal opening of an apparatus around a perimeter of the appliance that engages a wall, such that a hood portion of the apparatus extends outwardly from the perimeter of the distal opening to terminate in a proximal opening having a perimeter that is spaced apart from and opposing the distal opening to provide access to an interior volume of the apparatus and the appliance. A body portion of the apparatus is positioned to extend from the perimeter of the proximal opening downwardly below the hood portion. The method also may include placing an outlet of the apparatus in a receptacle. The outlet is in fluid communication with the body portion to enable flow of fluids from the interior volume of the body portion into the receptacle.

DETAILED DESCRIPTION

Figure 1:
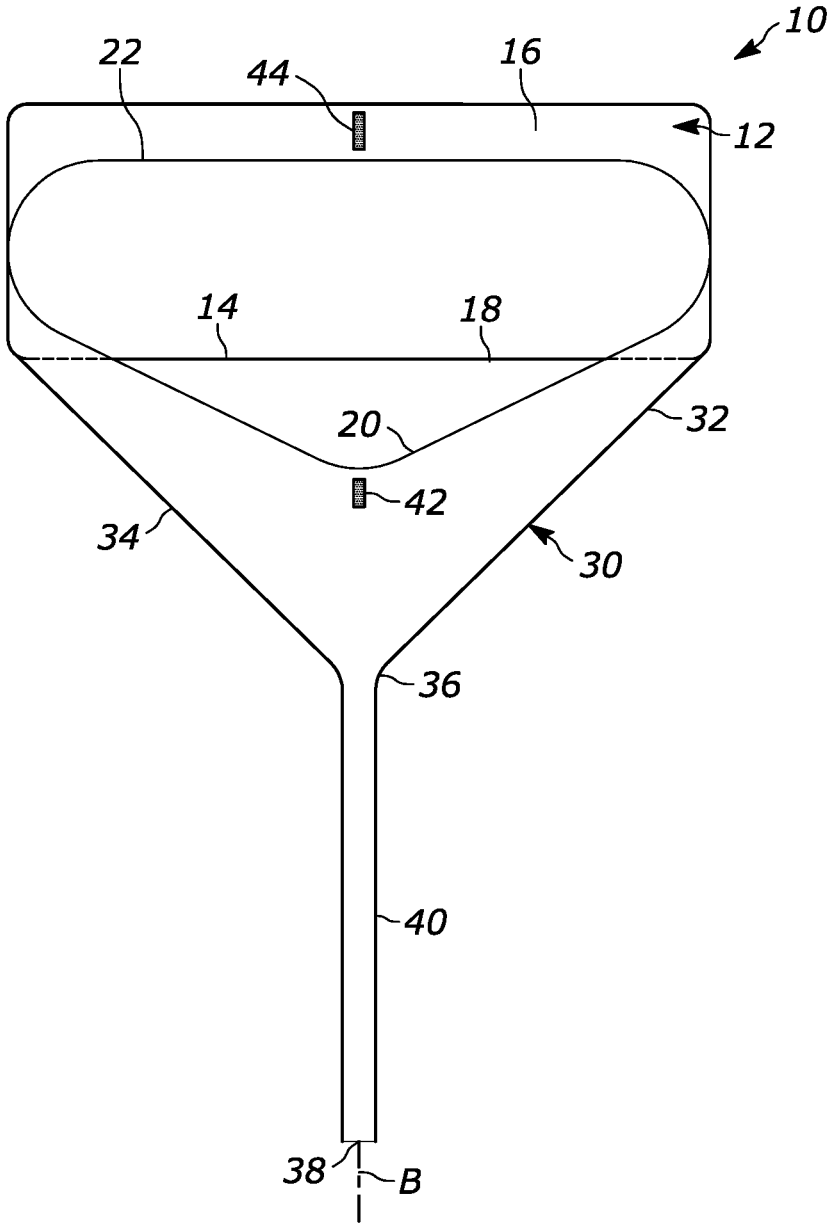
FIG. 1 is a front view depicting an example of an apparatus for maintenance and cleaning of a wall-mounted appliance.

This disclosure relates an apparatus and methods that can be utilized in conjunction with maintenance and/or cleaning of wall-mounted appliances. The apparatus includes a hood portion that includes a distal opening that is adapted to be positioned around a periphery of a wall-mounted appliance. As an example, the apparatus can be applied around an indoor wall-mounted unit of a ductless mini-split air conditioner. To facilitate its attachment to the wall-mounted appliance, a length of the perimeter of the distal opening can be adjustable, such as by including an elastic band within an enclosed passage (e.g., a tubular channel) along the perimeter of the distal opening. Additionally or alternatively, a cord may be provided within such enclosed passage and extend through an aperture in the enclosed passage. In this example, a locking mechanism may be used to fix the size of the distal opening and provide a tight fit around the wall-mounted appliance.

The hood portion further includes a sidewall formed of a web (e.g., one or more sheets) of pliant material (e.g., polyethylene or similar material) that extends outwardly from a perimeter of the distal opening to terminate in a proximal opening. The proximal opening has a perimeter that is spaced apart from and opposing the distal opening. The proximal opening is adapted to provide access to an interior volume of the hood portion generally residing between the first and second openings and thereby provide access to the wall-mounted appliance to which the apparatus is attached.

The apparatus also includes a body portion having that extends from sides of the hood portion and from a lower perimeter portion of the proximal opening. In an example, the body portion tapers along a longitudinal direction that is substantially transverse to a central axis of the distal opening. When in use, the body portion provides an interior volume into which fluid may flow from the wall-mounted appliance and be directed toward an outlet. In some examples, an elongated tubular portion (e.g., a hose) extends from a lower end of the body portion to enable the flow of fluids from the body portion and be directed to a receptacle (e.g., a bucket, drain or the like).

As a further example, a rim (e.g., lip) may extend outwardly from the perimeter of the distal opening, which may be inserted between the wall-mounted appliance and the wall to which it is affixed. The rim may thus provide a tight seal around the appliance. In this way, the surrounding wall may be further protected during cleaning and maintenance. In yet another example, that apparatus includes one or more fasteners to close the proximal opening. For example, hook and loop or other fasteners may be provided on opposite sides of the proximal opening and connected together to close the proximal opening while attached around the appliance.

By way of example, the apparatus may be installed around a wall-mounted appliance by extending the perimeter of the distal opening over and around the unit with the body portion and outlet positioned at the bottom of the apparatus extending downwardly from the appliance. Once attached, the proximal opening provides access to the appliance, which can be cleaned or otherwise maintained such as through the use of chemical cleaners, pressure washers or other cleaning solutions. After cleaning and maintenance has been completed, the proximal opening may be closed, such as by fastening a front edge of the perimeter of the proximal opening onto the hood portion of one or more fasteners (e.g., hook and loop fasteners, tape, press buttons or the like). With the proximal opening closed after cleaning, the appliance may be turned on and use circulating air to push residual fluid out of the appliance and into the body portion.

As disclosed herein, the apparatuses and methods facilitate cleaning of wall-mounted appliances (e.g., air conditioners) with various cleaners and pressurized water while reducing over spray. As a result, units may be maintained and cleaned without having to remove the unit from the wall. Advantageously, rinse water, dirt and other chemicals are directed through the body portion and funneled into the outlet, which may flow into a receptacle or drain. Additionally, in an example where the apparatus is fabricate of a transparent material, visibility of the appliance may be maintained throughout the cleaning and maintenance process.

Figure 2:
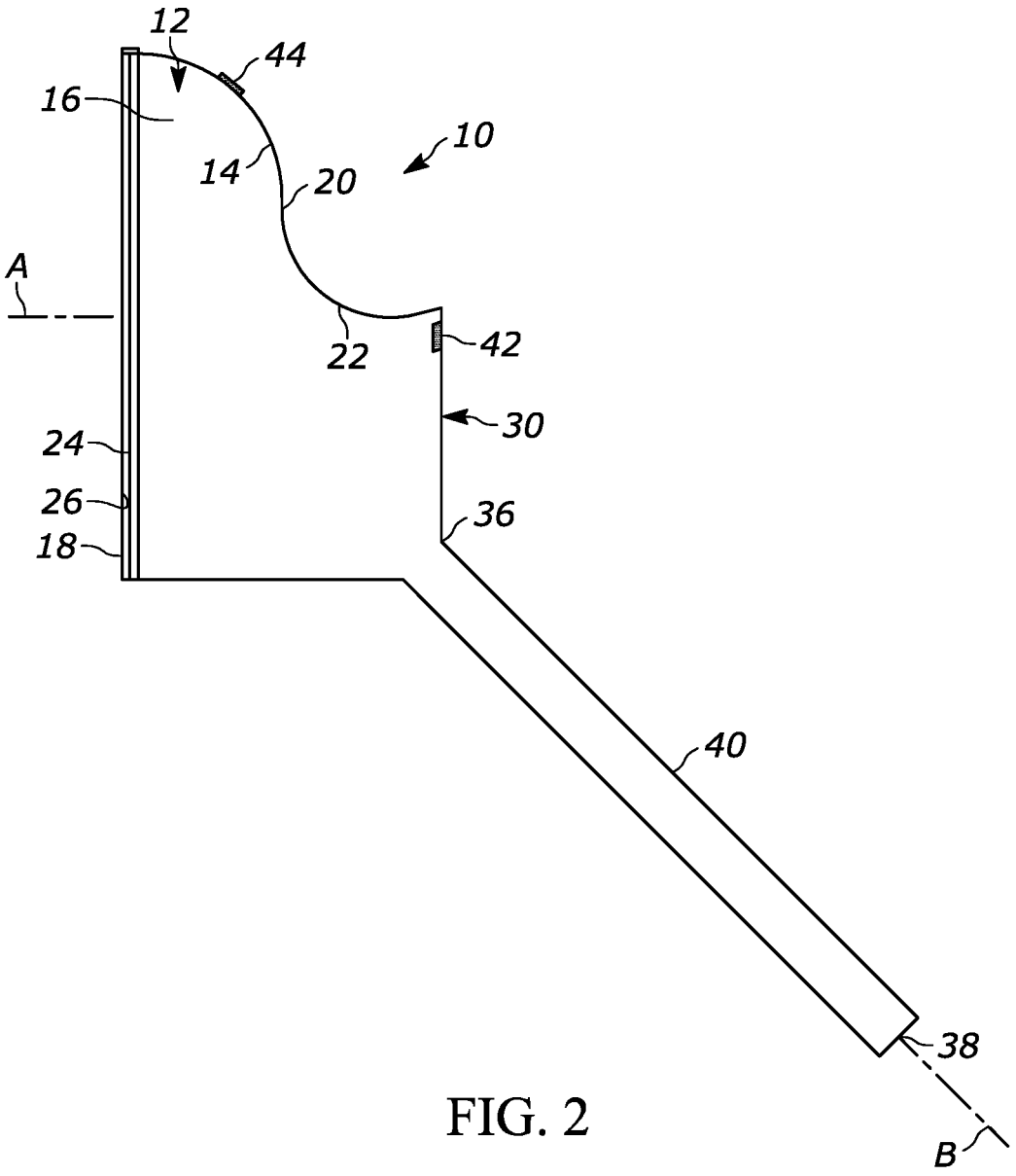
FIG. 2 is a side view of the apparatus of FIG. 1.

FIGS. 1 and 2 depict an example of an apparatus 10 that is adapted to be used for cleaning and maintenance of a wall-mounted appliance. FIG. 1 is a front view of the apparatus 10 and FIG. 2 is a side view of the apparatus. In an example, the wall-mounted appliance may be a ductless mini-split air conditioner that is mounted to a wall within an interior of a room. The apparatus 10 may be used to service other types of wall-mounted appliances (e.g., other types of air conditioners, heat pumps, ovens, commercial hand or hair dryers, and the like).

As shown in FIGS. 1 and 2, the apparatus 10 includes a hood portion 12 having a distal opening 14 that is adapted to be positioned around a periphery of a wall-mounted appliance and against the wall. The hood portion 12 also includes a sidewall 16 of a pliant material extending outwardly from the perimeter 18 of the distal opening 14 to terminate in a proximal opening 20 having a perimeter 22 that is spaced apart from and opposing the distal opening 14. In an example, a sheet of the pliant material extends from top and opposed side edges of the perimeter 18 of a generally rectangular distal opening 14 to define spaced apart lateral and top portions of the hood portion 12 between the openings 14 and 20. For example, the top of the hood portion 12 may extend from a top edge of the perimeter 18 and curve radially inwardly (downwardly with respect to axis A) as to be in spaced apart overlying relationship with respect to at least a substantial part of the distal opening. The proximal opening 20 thus provides access to an interior volume of the hood portion 12, as defined by the length of sidewall 16 (e.g., along the top and lateral portions) between the respective openings 14 and 20. The proximal opening 20 also provides access to an interior of a body portion 30 that extends away from the hood portion 12, as disclosed herein.

Also demonstrated in FIGS. 1 and 2, the body portion 30 extends from the perimeter 22 of the proximal opening 20 in a longitudinal direction that is substantially transverse to a central axis, indicated at "A", of the distal opening 14. In normal use, the body portion 30 may be in an expanded condition to provide an interior volume that is defined by the sidewall 16 of pliant material forming the body portion 30. To help maintain the expanded condition of the body portion 30, the perimeter 22 of the proximal opening 20 may be stiffened relative to the adjacent portion of the sidewall 16 of the pliant material. For example, the stiffening may be provided by forming the perimeter to flare outwardly (e.g., curved radially outwardly), such as by forming the flared when the edge is cut. In other examples, the body portion 30 may be urged to the expanded condition by applying multiple layers of the pliant material along the perimeter 22, attaching a stiffening material along the perimeter 22 or applying support structures within the body portion.

As demonstrated in FIG. 1, the body portion 30 can be configured to taper between its side edges 32 and 34 (e.g., corresponding to a lateral dimension) of the proximal opening toward a lower end 36 of the body portion 30 that is spaced in the longitudinal direction away from the first opening. For example, the body portion 30 may be funnel-shaped to facilitate transporting fluid along its interior wall toward an outlet 38.

The outlet 38 is in fluid communication with the interior of the body portion 30 by a corresponding tubular portion 40. For example, the tubular portion 40 extends longitudinally from the end 36 of the body portion 30 to terminate in the outlet 38. Thus, the outlet 38 is spaced axially apart from the end 36 by the corresponding sidewall of the tubular portion 40. The length of the tubular portion 40 may vary according to application requirements, such as dictated by the height above the ground of the appliance to which the apparatus 10 is being attached. In an example, the tubular portion 40 may extend along an axis "B" that is transverse to a plane in which the distal opening 14 lies, such as shown in the example of FIG. 2. In other examples, the tubular portion 40 may extend at other angles including at an angle that is parallel to the plane in which the distal opening 14 resides (see, e.g., FIG. 4). In the example of FIG. 1, the plane of the distal opening 14 is parallel with the drawing page and, in FIG. 2, such plane is orthogonal to the page.

The tubular portion 40 may be affixed or integrated to the end 36 of the body portion 30. For example, the tubular portion 40 may be formed of the same pliant material as the body portion 30 and hood portion 12 and joined to the end 36 of the body portion 30 (e.g., by welding, such as heat fusion). In other examples, the tubular portion 40 may be a length of a different type of material from the pliant material used to form the body portion 30. The tubular portion thus can be connected to the end 36 by an appropriate fastener, such as an adhesive, tape, clamp or other type of fastener.

To facilitate securing the apparatus 10 to an appliance, a length of the perimeter 18 of the distal opening 14 may be adjustable. In the example of FIGS. 1 and 2, an elongated elastic element extends along the perimeter 18 of the distal opening 14. As an example, the elastic element 24 may be an elastic cord within an enclosed passage 26 (e.g., tubular channel) along the perimeter 18. For example, the enclosed passage 26 may be formed by folding an edge of the perimeter back and heat fused (or otherwise bonded) to the adjacent material along the perimeter to provide a hollow along the perimeter 18. The elastic element 24 can be disposed in the passage. For example, the elastic element 24 may be formed of an elastic material (e.g., natural or artificial elastomers, stretchable fabrics or the like) that exhibits viscoelasticity. The elastic element 24 can mechanically bias the perimeter 18 to a reduced dimension in its normal (rest) condition. As a result, the elastic element 24 enables the perimeter 20 to be stretched (e.g., deformed) to a larger dimension in response to applying a force radially outwardly (e.g., by stretching it manually to a larger size than the appliance to which it is being applied). The elastic element 24 further enables the perimeter 18 to elastically return to its original length or approximating the periphery of the appliance when the applied force is removed. As a result, the elastic element 24 within the passage 26 operates to help hold the perimeter 18 in place around the appliance.

In some examples, the apparatus 10 includes means for closing the proximal opening 20. For example, one or more fasteners 42 and 44 can be attached near the perimeter 22 of the proximal opening 20 that can be connected together to close the opening 20 after cleaning and/or maintenance has been completed and a unit is turned on to dispel the fluid. As one example, the fasteners 42 and 44 may be applied on the interior sidewall at a front lower edge of the proximal opening 20 and to an outer portion of the sidewall 16 possibly the upper edge of the opening 20. Thus, the lower fastener 42 may be urged up and over into engagement with the upper fastener 44 to hold the opening 20 in a closed position. While the pair of mating fasteners 42 and 44 are demonstrated in examples of FIGS. 1 and 2, other numbers and types of structures may be used to close the opening. For example, fasteners could include adhesive, magnets, double sided tape, maybe buttons and the like. In a simple example, a piece of tape could be utilized as a fastener to close the opening 20. Examples of other devices that may be used to close the opening include a drawstring, one or more clips or hooks.

In some examples, the portions 12, 30 and 40 of the apparatus 10 may be fabricated as an integral structure from one or more sheets of the pliant material to provide a continuous outer shell having a corresponding internal volume. For example, the pliant material is in the form one or more sheets of polyethylene having a thickness that is less than or equal to about 2 mm. The polyethylene further may be transparent or at least translucent to facilitate visual inspection of the appliance from outside of the apparatus through the sidewall. In a multi-sheet example, seams between respective sheets are heat sealed (e.g., fused) or otherwise bonded together (e.g., with adhesives or stitching). In another example, the apparatus 10 may be formed as an integral structure by injection molding, extrusion, blowing or the like. The fabrication process may vary depending on the material being used to form each portion of the apparatus. As mentioned, different portions of the apparatus may be formed of the same or different materials.

Figure 3:
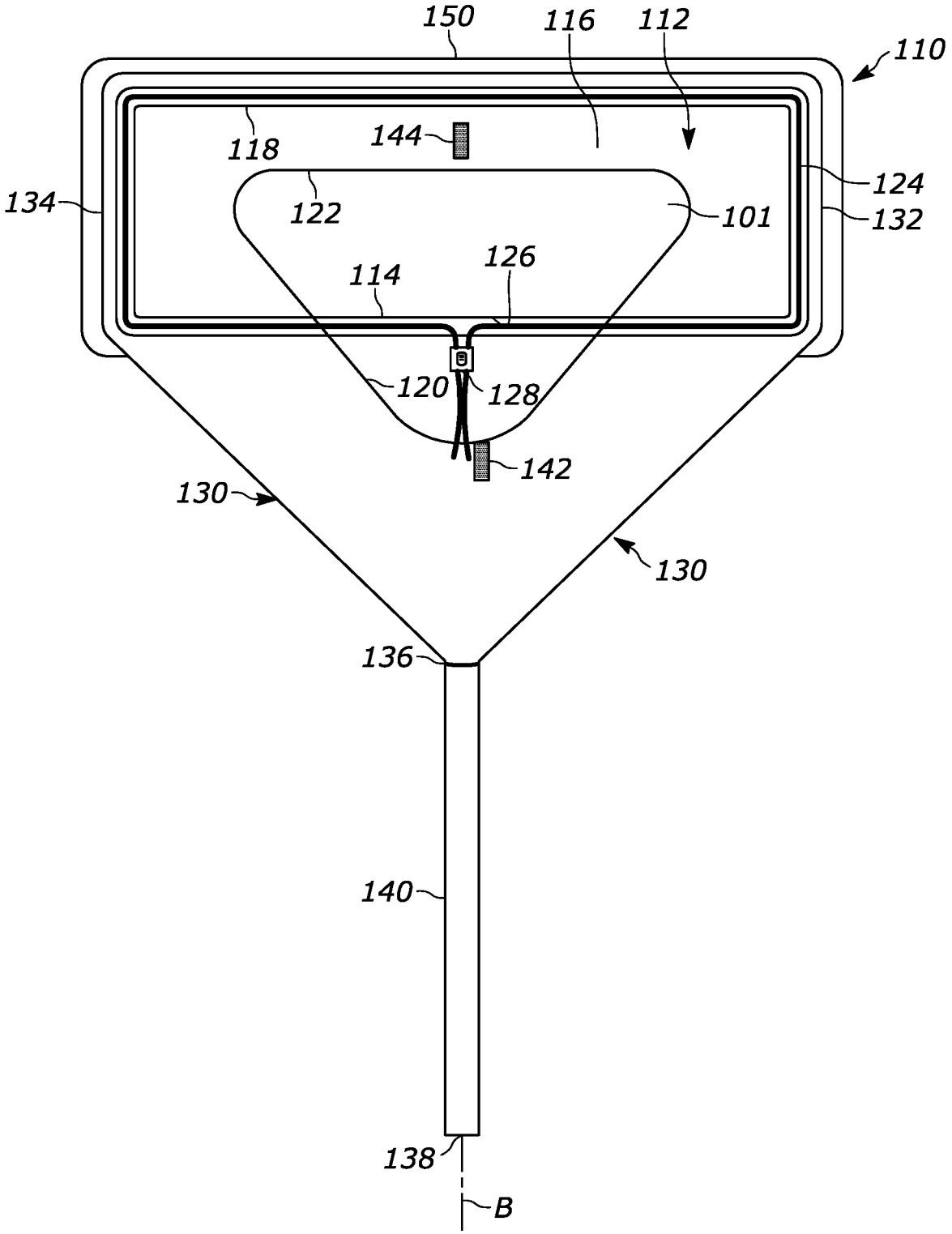
FIG. 3 is a front view depicting an example of another apparatus to facility maintenance and cleaning of a wall-mounted appliance.
Figure 4:
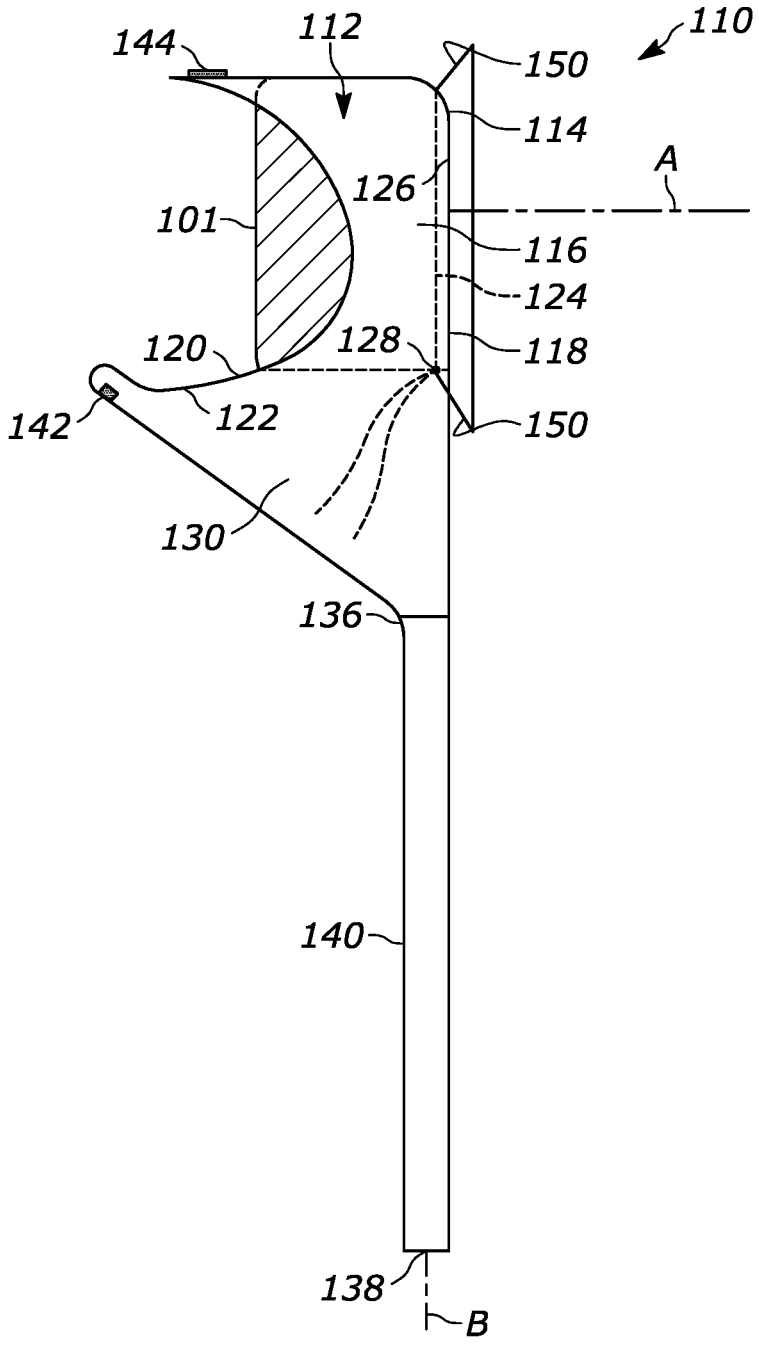
FIG. 4 is a side view of the apparatus of FIG. 3.

FIGS. 3 and 4 are front and side views, respectively, of another example embodiment of an apparatus 110 that can be used for cleaning and/or maintenance of a wall-mounted appliance. The general construction of the apparatus 110 is similar to the apparatus 10 in many respects. Accordingly, for ease of explanation, the same reference numbers, increased by adding 100, refer to like parts and features introduced above with respect to FIGS. 1 and 2. Additionally, similar materials and approaches may be used to form the apparatus 110 as disclosed with respect to FIGS. 1 and 2. Accordingly, reference may be made back to FIGS. 1 and 2 for further information. Additionally, individual features and parts that may differ in the various example embodiments may be utilized or substituted among each of the examples of apparatuses disclosed herein in various combinations.

The apparatus 110 includes a hood portion 112 having a distal opening 114 that is adapted to be positioned around a periphery of a wall-mounted appliance. The hood portion 112 also includes a sidewall 116 of a pliant material having top and spaced apart sides extending between the perimeter 118 of the distal opening 114 and a perimeter 122 of a proximal opening 120. As disclosed herein, the proximal opening 120 provides access to an interior of the apparatus 110, such as for servicing an appliance located therein.

The body portion 130 extends from the perimeter 122 of the proximal opening 120 in a longitudinal direction that is substantially transverse to a central axis, indicated at "A", of the distal opening 114. In normal use, the body portion 130 may be in an expanded condition to facilitate use. For example, the perimeter 122 of the proximal opening 120 may be formed or including stiffening elements to urge the proximal opening in an open condition, which also operates to help expand the volume of the body portion. As shown in the example of FIGS. 3 and 4, the body portion 130 tapers along its length in the longitudinal direction away from the first opening toward its end 136. For example, the body portion 130 may be funnel-shaped, reducing in diameter along its length between the lower edge of the perimeter 122 and the end 136. Alternatively, the diameter of sidewall of the body portion may remain substantially constant and be gathered together by a retaining ring or other structure (e.g., string, rope, band, etc.) to provide the funnel shape.

The apparatus 110 also includes an outlet 138 is in fluid communication with the interior of the body portion 130. In the example of FIGS. 3 and 4, a tubular portion 140 (e.g., having a diameter that approximates the diameter of the body portion at the end 136) extends longitudinally from the end 136 of the body portion 130 to terminate in the outlet 138. Thus, the outlet 138 is spaced axially apart from the end 136 by the corresponding sidewall of the tubular portion 140. In this example, the tubular portion 140 extends along an axis "B" that is parallel to a plane in which the distal opening 114 lies, such that when in use the entire distal side of the apparatus (e.g., perimeter 118 and associated hood portion 112, body portion 130 and tubular portion 140) may extend along a common plane (e.g., corresponding to a wall). As disclosed herein, the tubular portion 140 may be affixed or integrated to the end 136 of the body portion 130.

To facilitate securing the apparatus 110 to an appliance, a length of the perimeter 118 of the distal opening 114 may be adjustable. In the example of FIGS. 3 and 4, a length of a cord 124 is positioned within an enclosed passage 126 along the perimeter 118 of the distal opening 114. Specifically, the cord 124 is implemented as an adjustable drawstring cord. For example, ends of the cord 124 may extend through an aperture formed through a sidewall near a lower edge of the passage and pass through a locking mechanism 128. The locking mechanism 128 may be mechanically biased to retain the lengths of the elastic element 124 therein at a substantially fixed position. As an example, the locking mechanism 128 may include a release mechanism that is movable with respect to a housing of the locking mechanism. The position of the release mechanism thus may be moved to a first position to enable passage of the cord freely through the locking mechanism or to a second position to fix a portion of the cord within the locking mechanism. Thus, a user can adjust the length of the elastic element 124 that resides within the passage 126 and thereby fix the length of the perimeter 118 of the distal opening. Free ends of the connecting element 124 may extend along the locking mechanism 128 in a free condition or they may be attached together by an end connector. As a further, the cord may be implemented as an elastic cord (e.g., of an elastomer that exhibits viscoelasticity), which in conjunction with the locking mechanism 128 further facilitates its attachment and retention around a wall-mounted appliance.

The apparatus 110 also may include one or more fasteners for closing the proximal opening 120. For example, one or more fasteners (e.g., hook and loop fasteners, magnets, tape, zippers, buttons, etc.) 142 and 144 are attached near the perimeter 122 on opposite sides of the proximal opening 120. The fasteners 142 and 144 thus can be connected together to close the opening 120, such as after cleaning and/or maintenance has been completed and a unit is turned on to dispel the fluid. Other numbers and types of fasteners may be used in other examples.

In the example of FIGS. 3 and 4, the apparatus 100 also includes a connecting rim 150 that extends from the perimeter 118 of the distal opening 114. The rim 150 may extend radially outwardly or inwardly with respect to the perimeter 118. In an example, the outwardly extending rim 150 extends outwardly a length (e.g., about 1 to 4 inches, such as 3 inches) from the entire perimeter. For example, one or more layers of the pliant material (e.g., the same material as the sidewall 116 used for hood and body portions 112 and 130) may extend outwardly from the perimeter 118 to form the rim 150. In other examples, the rim 150 may be formed of a sheet of the pliant material having a greater thickness than the hood or body portion. In another example, the rim 150 may be formed of a different, more rigid material than the pliant material used for the sidewall 116 of the hood portion 102. As yet another example, the rim may be implemented as a plurality of tabs extending from the perimeter 118 at spaced apart locations along the perimeter. The rim 150 provides a further shield that may be inserted between the wall appliance and the wall to further reduce contamination and protect the wall from fluids that may be applied within the volume of the hood for cleaning or otherwise maintaining the appliance 101. By inserting the rim between the wall and appliance, it also operates as a further retaining mechanism to hold the apparatus in place around the appliance during servicing.

Figure 5:
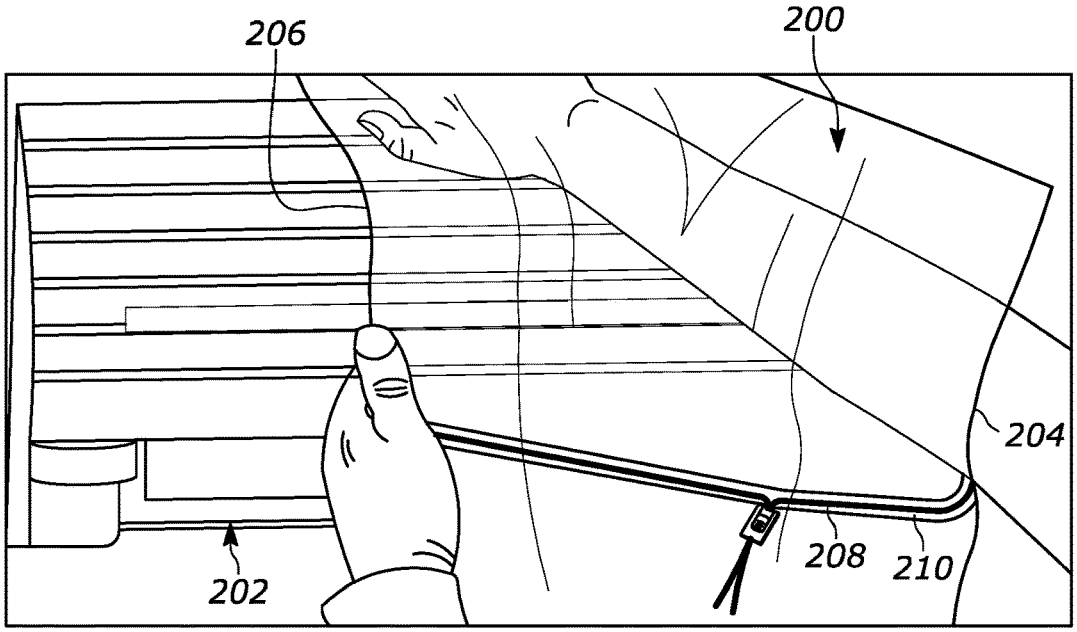
FIG. 5 depicts an apparatus being applied to a wall that is mounted appliance.

FIG. 5 depicts an example of an apparatus 200 being applied to a wall-mounted appliance 202. The apparatus 200 may be any of the example apparatuses disclosed herein (e.g., apparatus 10 or 110). In the example of FIG. 5, a right-side lateral edge 204 of the distal opening has been positioned along a right-side of the appliance 202, while the opposite lateral edge 206 is being pulled over and across the appliance 202. As shown in FIG. 5, the apparatus 200 includes a cord 208 (e.g., corresponding to elastic element 24 or cord 124) within an enclosed passage 210. In this example, two lengths of the cord 208 extend through a locking mechanism 212 to facilitate adjusting a length of the perimeter of the distal opening to the appropriate size to facilitate holding the unit in a proper position during the cleaning process.

Figure 6:
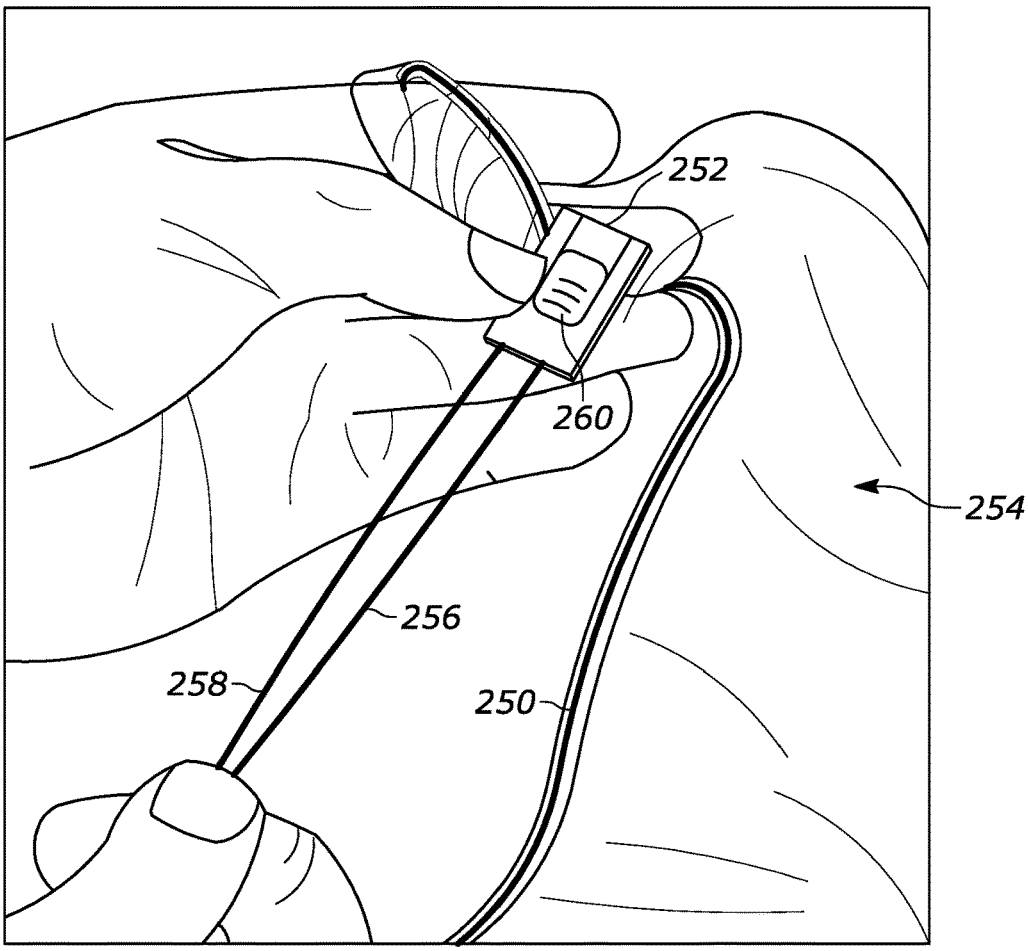
FIG. 6 illustrates an example of an adjustment mechanism and associated lock that can be used to secure the apparatus around a wall-mounted appliance.

As a further example, FIG. 6 shows an enlarged view of a cord 250 and locking mechanism 252 such as for use in secure an apparatus 254 to an appliance (not shown). As shown in FIG. 6, lengths of opposing sides of the cord 256 and 258 extend through the locking mechanism 252. The locking mechanism 252 includes a button or slide 260 that may be moved to a first position to enable the free passage of the cords 256 and 258 through an interior of the locking mechanism 252 and to a second position in which the locking mechanism fixes the position of the cords within the locking mechanism. Various types of devices may be used to implement the locking mechanism 252, such as single hole bubble cord locks, dual hole toggle cord locks, 2-hole bean cord locks, cylinder hole-top cord locks, barrel style cord locks, lock style cord locks, double hold style cord locks, or cord lock stoppers that include sliding wheels.

Figure 7:
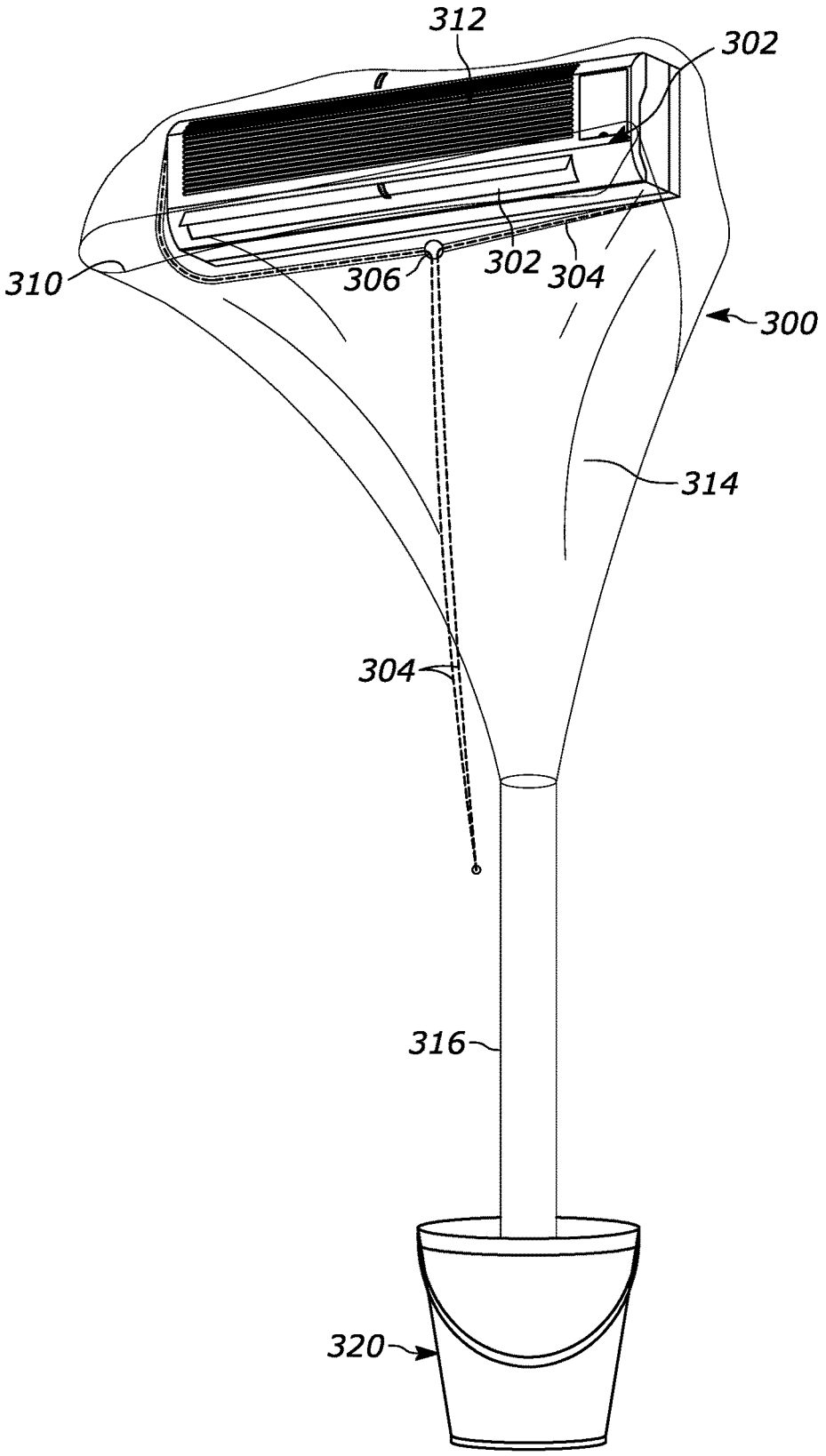
FIG. 7 depicts an example of an apparatus attached to a wall-mounted appliance.

FIG. 7 illustrates an example of the apparatus 300 that has been applied to the wall-mounted appliance 302. The apparatus 300 may be implemented as any of the example apparatuses (e.g., apparatuses 10, 110) disclosed herein. In the example of FIG. 7, a drawstring cord 304 has been tightened to hold the apparatus 300 around the periphery of the unit, such as disclosed with respect to FIG. 6. In the example of FIG. 7, the length of cords 304 between the ends and the locking mechanism 306 reside outside of the interior volume of the apparatus 300, such as to avoid contact with fluids that flow through the apparatus. Also as shown, the proximal opening 310 is configured to hold the hood portion 312 and body portion 314 in an expanded condition, such as due to stiffening applied of along the perimeter of the proximal opening as disclosed herein. Also demonstrated in FIG. 7, the tubular portion 316 has been inserted into a receptacle (e.g., a bucket) 320 for collection of fluids during the cleaning process.

Figure 8:
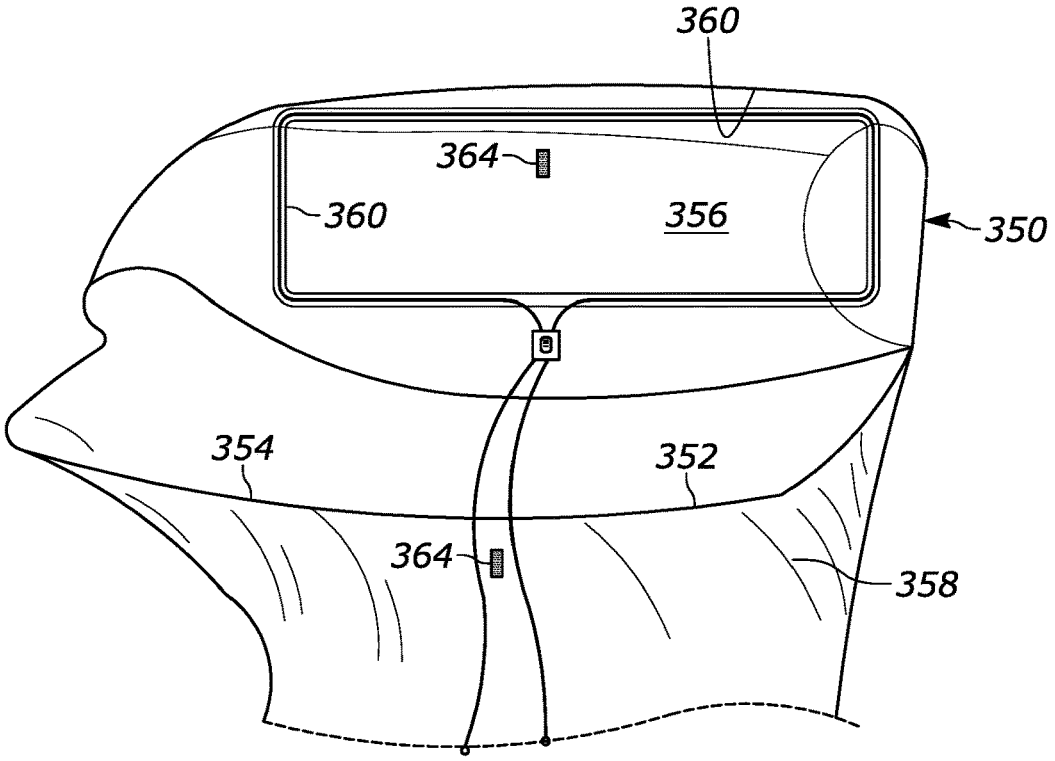
FIGS. 8 and 9 depict examples of an apparatus in open and closed conditions, respectively.
Figure 9:
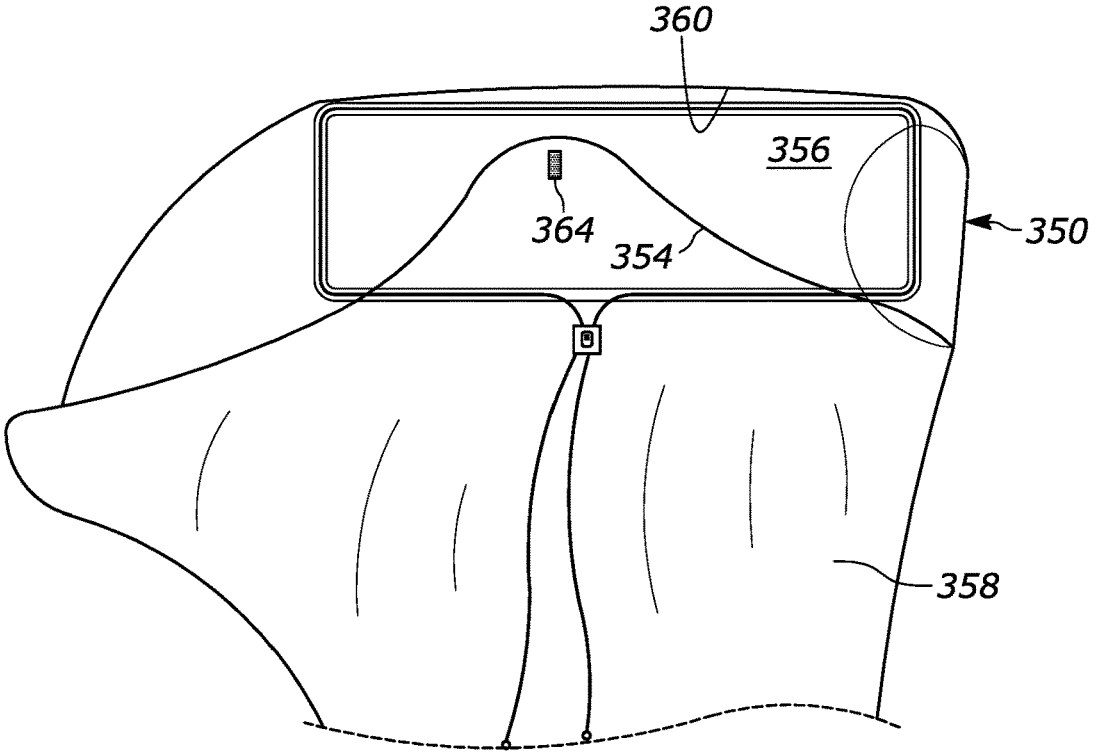

FIGS. 8 and 9 illustrate of part of an apparatus 350 to demonstrate an example of closing a proximal opening 352 of the apparatus, such as after the cleaning has been completed. In FIG. 8, the proximal opening 352 is shown in its open expanded condition in which the perimeter 354 of the proximal opening along the hood portion 356 and body portion 358 extend outwardly from the distal opening 360. For example, the front lower edge of the perimeter 354 of the proximal opening is curved radially outwardly to provide desired stiffening and help hold the body portion away from the plane in which the distal opening resides. In FIG. 9, the proximal opening is shown in the closed condition. As described, the proximal opening 352 can be closed to facilitate collection of additional debris and drying of the appliance after the unit has been turned on.

Also demonstrated in FIGS. 8 and 9 the apparatus includes fasteners 364 to enable the proximal opening to remain closed, as shown in FIG. 9. For example, in FIG. 8, the fasteners 364 are spaced apart from each other to provide for the open apparatus. In FIG. 9, the fasteners 364 have been placed into contact with each other to hold the proximal opening 352 in the closed condition in which a front panel of body portion 358 is urged over the top of the hood portion such that the mating fasteners 364 engage one another to thereby hold the opening in its closed condition shown in FIG. 9.

Figure 10:
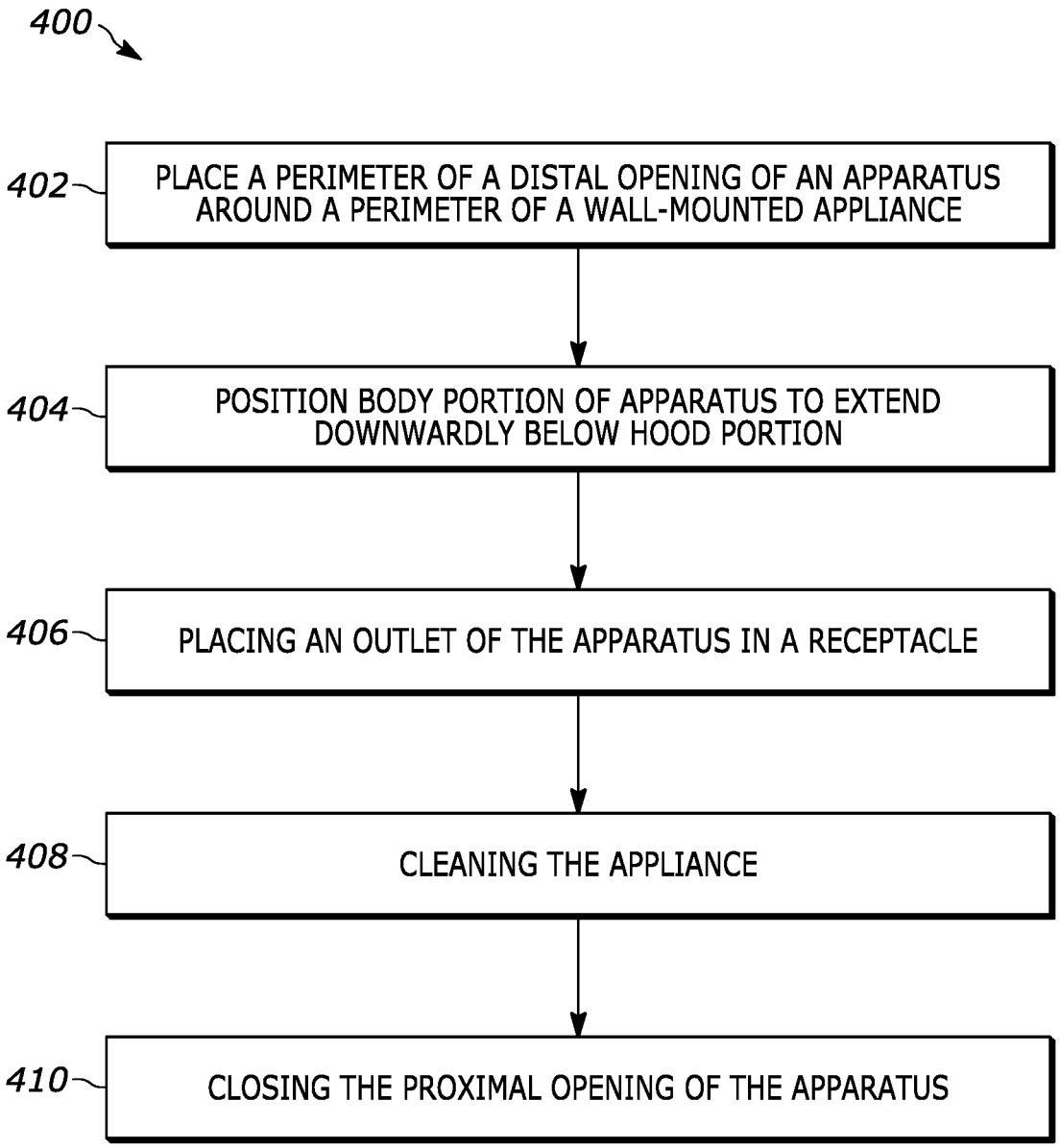
FIG. 10 is a flow diagram depicting an example of a method to perform maintenance and/or cleaning of a wall-mounted appliance.

FIG. 10 is a flow diagram depicting an example of a method 400 to perform maintenance and/or cleaning of a wall-mounted appliance. The method 400 may be implemented using any apparatus and with any combination of features disclosed herein (see, e.g., FIGS. 1-9). At 402, the method includes placing a perimeter of a distal opening of the apparatus around a perimeter of the appliance. The perimeter may be pushed over the appliance to engage the adjacent wall. In some examples, a rim extending from the perimeter of the distal opening is inserted between the wall and the appliance to further protect the wall and surroundings from fluids that may be applied. As disclosed herein, when the apparatus is placed around the appliance (at 402), the hood portion of the apparatus extends outwardly from the perimeter of the distal opening to terminate in a proximal opening having a perimeter that is spaced apart from and opposing the distal opening to provide access to an interior volume of the apparatus and the appliance.

In an example, the apparatus includes an elastic element along the perimeter of the distal opening that can help hold the perimeter of the distal opening around the periphery of the appliance when placed thereon (e.g., at 402). Additionally or alternatively, apparatus includes a cord (e.g., cord 124, 208, 250, 304) within an enclosed passage along the perimeter of the distal opening. The enclosed passage includes may include an aperture through a sidewall thereof, such as along a lower edge of the perimeter of the distal opening. In this example, as part of the placement at 402, a length of the cord is pulled from the enclosed passage to reduce the size of the perimeter of the distal opening and approximate the periphery of the appliance. A locking mechanism further may be set to fix the length of the cord within the enclosed passage to hold the perimeter of the distal opening against periphery of the appliance.

At 404, a body portion of the apparatus is positioned to extend from the perimeter of the proximal opening downwardly below the hood portion. This positioning (at 404) may include manual fluffing of the apparatus or result from act of placing the apparatus around the appliance (at 402). At 404, an outlet of the apparatus is placed in a receptacle (e.g., bucket 320). The outlet is in fluid communication with the body portion (e.g., by tubular portion 40, 140, 316) to enable flow of fluids from the interior volume of the body portion into the receptacle.

At 408, the appliance is cleaned. The cleaning may include spraying chemicals and/or water onto coils or other parts of the appliance that resides within the volume of the apparatus. In response, at least a portion of the volume of fluid sprayed onto the appliance flows from the appliance into the interior volume of the body portion and discharges from the outlet into the receptacle. At 410, the proximal opening of the apparatus is closed. For example, while the proximal opening is closed after spraying the fluid, and the method 400 can include activating the appliance (e.g., turning it on while power is being supplied) to facilitate removal of remaining fluid from the appliance and/or drying of the appliance. Because the proximal is closed while the appliance is activated, circulating air pressure generated by the appliance can push residual water fluid into the interior volume of the apparatus, which may be vented from the appliance into the body portion.

In view of the foregoing apparatuses and methods disclosed herein, the apparatus provides access to clean the appliance without removing it first from the wall. The apparatus is configured to provide a stable and self-supporting enclosure that requires no additional adjustments when installed. As a result, cleaning of the appliance, including with coil cleaners and pressurized water, is facilitated through the proximal opening while reducing overspray around the entire unit. Additionally, rinse water and dirt is funneled into the tubular portion, which can be put into a receptacle (e.g., bucket or drain) to collect the water and dirt. The transparency of the plastic material further allows easy viewing throughout the cleaning process. After cleaning is completed, the apparatus may be removed and reused. For example, the apparatus can be easily uninstalled in one motion and installed again on other appliances.

What have been described above are examples. It is, of course, not possible to describe every conceivable combination of components or methods, but one of ordinary skill in the art will recognize that many further combinations and permutations are possible. Accordingly, the disclosure is intended to embrace all such alterations, modifications, and variations that fall within the scope of this application, including the appended claims.

As used herein, the term "includes" means includes but not limited to, the term "including" means including but not limited to. Additionally, where the disclosure or claims recite "a," "an," "a first," or "another" element, or the equivalent thereof, it should be interpreted to include one or more than one such element, neither requiring nor excluding two or more such elements. In this description, the term "based on" means based at least in part on.

What is claimed is:

1. An apparatus, comprising:

a hood portion including a distal opening adapted to be positioned around a periphery of a wall-mounted appliance, the hood portion including a sidewall of a pliant material extending outwardly from a perimeter of the distal opening to terminate in a proximal opening having a perimeter that is spaced apart from and opposing the distal opening, the proximal opening to provide access to an interior volume of the hood portion corresponding to the sidewall between the distal and proximal openings;

a body portion extending from the perimeter of the proximal opening in a longitudinal direction that is substantially transverse to a central axis of the distal opening; and an outlet in fluid communication with the body portion to enable flow of fluids from an interior volume of the body portion, the body portion being movable away from the outlet into engagement with the exterior of the hood portion to close the proximal opening.

2. The apparatus of claim 1, wherein the distal opening is adapted to adjust a length of the perimeter of the distal opening.

3. The apparatus of claim 2, further comprising an elongated elastic element extending along the perimeter of the distal opening.

4. The apparatus of claim 2, further comprising:

an enclosed passage along the perimeter of the distal opening, the enclosed passage including an aperture through a sidewall thereof along a lower edge of the perimeter of the distal opening; and a length of a cord extending within the enclosed passage and extending through the aperture.

5. The apparatus of claim 4, further comprising a locking mechanism adapted to fix the length of the cord that is within the enclosed passage.

6. The apparatus of claim 1, wherein the body portion tapers from a first dimension at the perimeter of the proximal opening toward a body end that is spaced in the longitudinal direction away from the distal opening.

7. The apparatus of claim 6, further comprising an elongated hose extending from the body end to terminate in the fluid outlet.

8. The apparatus of claim 1, further comprising a rim extending a length from the perimeter of the distal opening.

9. The apparatus of claim 8, wherein the rim comprises at least one layer of the pliant material.

10. The apparatus of claim 1, further comprising a stiffening feature along at least a portion of the perimeter of the proximal configured to urge the perimeter of the proximal opening away from the distal opening toward an open condition.

11. The apparatus of claim 10, wherein the stiffening feature comprises an edge of the perimeter of the proximal opening that is curved radially outwardly away from a central axis of the proximal opening.

12. The apparatus of claim 1, further comprising means for closing the proximal opening.

13. The apparatus of claim 12, wherein the means for closing comprises mating fasteners affixed on each of the hood portion and the body portion.

14. The apparatus of claim 12, further comprising a receptacle having an interior volume adapted to receive and collect fluid from the outlet.

15. The apparatus of claim 1, wherein proximal opening is substantially aligned with the distal opening and extends uninterrupted across the entire front of the hood portion.

16. A method to facilitate servicing a wall-mounted appliance, comprising:

placing a perimeter of a distal opening of an apparatus around a periphery of the appliance that engages a wall, such that a hood portion of the apparatus extends outwardly from the perimeter of the distal opening to terminate in a proximal opening having a perimeter that is spaced apart from and opposing the distal opening to provide access to an interior volume of the apparatus and the appliance, positioning a body portion of the apparatus configured for upward movement into engagement with the exterior of the hood portion to close the proximal opening to extend from the perimeter of the proximal opening downwardly below the hood portion; and placing an outlet of the apparatus in a receptacle, the outlet being in fluid communication with the body portion to enable flow of fluids from the interior volume of the body portion into the receptacle.

17. The method of claim 16, wherein apparatus includes an elastic element along the perimeter of the distal opening to help hold the perimeter of the distal opening around the periphery of the appliance.

18. The method of claim 16, wherein apparatus includes a cord within an enclosed passage along the perimeter of the distal opening, the enclosed passage including an aperture through a sidewall thereof along a lower edge of the perimeter of the distal opening, the method further comprising:

pulling a length of the cord from the enclosed passage to reduce a size of the perimeter of the distal opening and approximate the periphery of the appliance; and setting a locking mechanism to fix the length of the cord within the enclosed passage to hold the perimeter of the distal opening against the periphery of the appliance.

19. The method of claim 18, further comprising:

wherein prior to closing the proximal opening, the method comprises spraying a volume of fluid onto the appliance such that at least a portion of the volume of fluid flows from the appliance into the interior volume of the body portion and discharges from the outlet into the receptacle, wherein the proximal opening is closed after spraying the fluid, and the method further comprises activating the appliance to facilitate removal of remaining fluid from the appliance.

20. The method of claim 16, further comprising closing the proximal opening.

21. The method of claim 16, wherein the apparatus comprises a rim extending from the perimeter of the distal opening, the method further comprising inserting the rim between the wall and the appliance.

22. The method of claim 16, further comprising closing the proximal opening by moving the body portion away from the outlet into engagement with the exterior of the hood portion.

* * * * *